US006518858B2

(12) United States Patent
Ando et al.

(10) Patent No.: US 6,518,858 B2
(45) Date of Patent: Feb. 11, 2003

(54) RESONATOR, FILTER, DUPLEXER, AND COMMUNICATION APPARATUS

(75) Inventors: Masamichi Ando, Kyoto (JP); Norihiro Tanaka, Nagaokakyo (JP); Hidekazu Sasai, Uji (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 09/803,213

(22) Filed: Mar. 9, 2001

(65) Prior Publication Data

US 2001/0022543 A1 Sep. 20, 2001

(30) Foreign Application Priority Data

Mar. 14, 2000 (JP) ..... 2000-070533

(51) Int. Cl.[7] ..... H01P 1/213; H01P 1/202

(52) U.S. Cl. ..... 333/134; 333/207; 333/223; 333/234

(58) Field of Search ..... 333/223, 222, 333/209, 134, 234, 229, 231, 235, 207

(56) References Cited

U.S. PATENT DOCUMENTS

| | | | | | |
|---|---|---|---|---|---|
| 3,733,567 | A | * | 5/1973 | Johnson | 333/226 |
| 4,041,421 | A | * | 8/1977 | Owlett | 333/209 |
| 4,249,148 | A | * | 2/1981 | Jachowski | 333/208 |
| 4,521,754 | A | * | 6/1985 | Ranghelli et al. | 333/207 |
| 5,153,541 | A | * | 10/1992 | Johnson et al. | 333/203 |

FOREIGN PATENT DOCUMENTS

| | | | |
|---|---|---|---|
| GB | 1306406 | 2/1973 | H01P/1/30 |
| GB | 2305547 A | 4/1997 | H01P/1/30 |

* cited by examiner

*Primary Examiner*—Robert Pascal
*Assistant Examiner*—Dean Takaoka
(74) *Attorney, Agent, or Firm*—Dickstein, Shapiro, Morin & Oshinsky

(57) ABSTRACT

A resonator includes a conductive casing provided with a threaded screw hole, a screw at least partially inserted into the casing, and a fixing member fixing the screw and having a threaded screw hole. In the resonator, the linear expansivity of the casing and the linear expansivity of the fixing member, and preferably also that of the screw, are substantially equal.

9 Claims, 5 Drawing Sheets

RESONATOR, FILTER, DUPLEXER, AND COMMUNICATION APPARATUS

BACKGROUND OF THE INVENTION

1. Field of the Invention

The present invention relates to a base-station resonator, a filter, a duplexer, and a communication apparatus of a communication facility for use in a microwave band or a millimeter wave band.

2. Description of the Related Art

A conventional resonator is described with reference to FIGS. 6 and 7. FIG. 6 is an exploded perspective view of the conventional resonator, and FIG. 7 is a cross-sectional view taken along line Y—Y of FIG. 6.

As shown in FIGS. 6 and 7, a conventional resonator 110 includes a casing 111 having a main unit 111*a* and a cover unit 111*b* and serving as a resonant space, a columnar inner conductor 112 having one end thereof connected to the center of the inner bottom of the casing main unit 111*a,* screw 113 inserted into the casing 111 from the casing cover unit 111*b,* and a nut 114 serving as a fixing member for fixing the screw 113. Here, the screw 113 is used to change the resonant frequency of the resonator 110 by varying its insertion position to change the capacitance between the screw 113 and the end of the inner conductor 112.

Generally, since this sort of base-station resonator 110 is used at a high power level, a large amount of heat is generated in use. Accordingly, the casing 111, the inner conductor 112, and the screw 113 are formed from Invar or the like, which is expensive but has very small linear expansivity (coefficient of thermal expansion), so that characteristics such as the resonant frequency are not changed due to a change in the position of the screw 113 or the change in the resonant space itself specified by the size or shape of the casing 111 that is caused by a change in the temperature. Alternatively, the casing 111 is formed from an inexpensive material such as aluminum, and the inner conductor 112 and the screw 113 are formed from a different material whose linear expansivity is different from that of the casing. In this case, the material of the inner conductor 112 and the screw 113 is selected from suitable materials so as to offset any change in the resonant frequency due to a change in the resonant space constituted by the casing 111 that is caused by a short-term temperature change. On the other hand, the nut 114 for fixing the screw 113 is formed using an inexpensive metal such as commonly distributed iron.

As described above, the casing and the screw of the conventional resonator are made from a metal such as Invar and the nut for fixing the screw is made from a metal such as iron. Accordingly, when a long-term cyclical temperature change is caused by heat generated from the resonator itself or a change in the external environment in use, a difference develops between the force the casing applies to the screw and the force the nut applies to the screw, due to the difference between the linear expansivity of the casing and the linear expansivity of the nut, or the difference between that of the screw and that of the nut. This force difference loosens the screw. Since this changes the position of the screw, there arises a problem that the resonant frequency deteriorates with age.

When the resonator is manufactured, an aging process is required, normally at a high temperature, in order to ensure the reliability of the resonator characteristics. However, even though the screw insertion position is adjusted and then fixed with the nut, the above linear expansivity difference causes the resonant frequency of the resonator to be changed during the aging process. Therefore, there is a problem that readjustment is required.

SUMMARY OF THE INVENTION

In order to address these problems, the present invention provides a resonator, a filter, a duplexer, and a communication apparatus wherein characteristics such as the resonant frequency are stable for a long period regardless of the occurrence of cyclical changes in the temperature.

To this end, according to a first aspect of the present invention, there is provided a resonator having a conductive casing provided with a threaded screw hole, a screw at least partially inserted into the screw hole, and a fixing member fixing the screw and also having a threaded screw hole. In the resonator, the linear expansivity of the casing and the linear expansivity of the fixing member are substantially equal.

When the linear expansivities of the casing and the fixing member are substantially the same in this manner, the looseness of the screw due to the cyclic temperature change does not occur. This causes the position of the screw to be stabilized. Therefore, the stability of the resonant frequency with age is increased.

In the resonator, the linear expansivity of the casing, the linear expansivity of the fixing member, and the linear expansivity of the screw may be substantially equal. By causing not only the linear expansivities of the casing and the fixing member to be substantially equal, but also causing the linear expansivities of the casing and the fixing member to be substantially equal to that of the screw, the stability of the resonant frequency with age is increased even more.

According to a second aspect of the present invention, a resonator includes a conductive casing provided with a threaded screw hole, a screw at least partially inserted into the casing, and a fixing member fixing the screw and having a threaded screw hole. In the resonator, the casing and the fixing member are made from the same material.

Thus, when the casing and the fixing member constituting the resonator are each formed using a metal such as Invar, since there is no difference in the linear expansivities of the casing and the screw, the screw is not loosened. Therefore the stability of the resonant frequency with age is increased.

In the resonator, the casing, the fixing member, and the screw may be made from the same material. When not only the casing and the fixing member but also the screw are all formed using a metal such as Invar, the stability of the resonant frequency with age is increased even more.

Alternatively, in the resonator, one end of a rod-shaped inner conductor is connected to the inner wall face of the casing, and the axis of the inner conductor and the axis of the screw are substantially aligned.

In the resonator having the casing provided with the inner conductor in which one end thereof is connected and the other end thereof is open, the electrical field intensity of the open end is great. Accordingly, when the axis of the inner conductor and the axis of the screw are substantially aligned, as the capacitance between the open end of the inner conductor and the screw increases, the proportion of the amount of the change in the capacitance to the amount of the change in the screw position increases. This means that, in the resonator having such a construction, the resonant frequency is sensitively changed in accordance with the position of the screw. Particularly, a characteristic change due to mechanical aging caused by long-term cyclic temperature change is a great problem in the resonator having such a construction. The present invention is very effective particularly in the resonator having such a construction.

Furthermore, in the resonator, the number of threads of the casing that engage with the screw and the number of threads of the fixing member that engage with the screw may be substantially equal. When the screw is inserted into the casing and the screw is fixed with the fixing member, the screw is pulled downward by the casing and pulled upward by the fixing member. These pulling forces are balanced. When a temperature change subtly alters the forces applied by the casing and the fixing member to the screw, the one having more threads can have more influence on the screw. That is, by causing the number of threads of the casing and the number of threads of the fixing member to be substantially equal, a resonator which is stable over a longer-term cyclic temperature change can be obtained.

According to a third aspect of the present invention, a filter includes the above-described resonator, and an input/output connection unit.

According to a fourth aspect of the present invention, a duplexer includes at least two filters, input/output connection units connected respectfully to each filter, and an antenna connection unit commonly connected to the filters. In the duplexer, at least one of the filters is the above-described filter.

According to a fifth aspect of the present invention, a communication apparatus includes the above-described duplexer, a transmission circuit connected to at least one of the input/output connection units of the duplexer, a reception circuit connected to at least one of the input/output connection units that is different from the input/output connection unit connected to the transmission circuit, and an antenna connected to the antenna connection unit of the duplexer.

The communication apparatus may further comprise at least one of a transmitting circuit and a receiving circuit, and the above-described filter being connected to or forming a part of said circuit.

As described above, according to the present invention, in the resonator which includes the casing, the inner conductor provided in the casing, the screw partly inserted into the casing, and the fixing member for fixing the screw, the difference between the linear expansivity of the casing and the linear expansivity of the fixing member, or the difference between that of the casing or the screw and that of the fixing member, is substantially eliminated. This prevents the resonant frequency of the resonator from being varied due to the looseness of the screw that is caused by the long-term cyclic temperature change in use or the temperature change during an aging process. Accordingly, the long-term reliability of the resonator is improved.

Other features and advantages of the present invention will become apparent from the following description of embodiments of the invention which refers to the accompanying drawings, in which like references denote like elements and parts.

BRIEF DESCRIPTION OF THE DRAWING(S)

DETAILED DESCRIPTION OF EMBODIMENTS OF THE INVENTION

Figure 1:
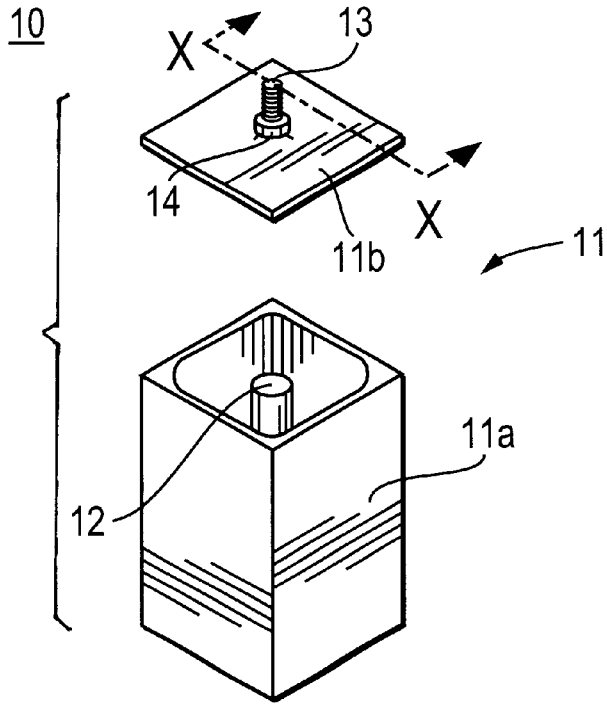
FIG. 1 is an exploded perspective view of a resonator according to the present invention.

Hereinafter, a resonator according to an embodiment of the present invention is described with reference to FIGS. 1 and 2. FIG. 1 is an exploded perspective view of the resonator according to the present invention, and FIG. 2 is a cross-sectional view taken along line X—X of FIG. 1.

Figure 2:
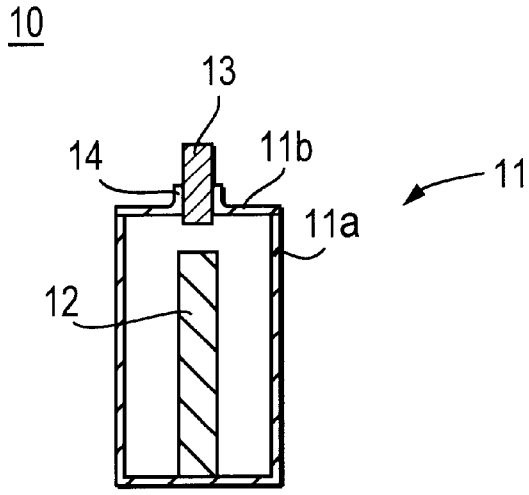
FIG. 2 is a cross-sectional view taken along line X—X of FIG. 1.

As shown in FIGS. 1 and 2, a resonator 10 according to the present embodiment includes a casing 11 having a main unit 11*a* and a cover unit 11*b* and serving as a resonant space, a columnar inner conductor 12 having one end thereof connected to the center of the inner bottom of the casing main unit 11*a,* a screw 13 inserted into a threaded screw hole in the casing 11 from the casing cover unit 11*b,* and a nut 14 serving as a fixing member for fixing the screw 13. Here, the screw 13 is used to change the resonant frequency of the resonator 10 by varying its insertion position to change the capacitance between the screw 13 and the end of the inner conductor 12.

In the present embodiment, the casing 11, the screw 13, and the nut 14 are each formed from Invar. Therefore, since there is no linear expansivity difference between the casing 11 and the nut 14, or between the screw 13 and the nut 14, the temperature change in use or in an aging process at a high temperature does not loosen the screw 13. That is, since there is no change in the resonant frequency due to the looseness of the screw, a stable resonator for a long-term cyclic temperature change can be obtained. In addition, since the number of threads in the screw hole of the casing 11 and the number of threads of the nut 14 are equal in the present embodiment, the characteristics of the resonator 10 are further stabilized for a long-term cyclic temperature change.

The casing 11, the screw 13, and the nut 14 are each formed from Invar in the present embodiment. However, as long as the materials of the casing 11 and the nut 14, or the materials of the casing 11, the screw 13 and the nut 14, are the same, they may be made from another material. Furthermore, as long as the materials of the casing 11 and the nut 14, or the materials of the casing 11, the screw 13 and the nut 14, have substantially the same linear expansivity, they may be formed from different materials. For example, combinations of brass and aluminum, of austenitic stainless steel and nickel, of ferritic stainless steel and phosphor bronze, and of ferritic stainless steel and copper, may be used.

Figure 3:
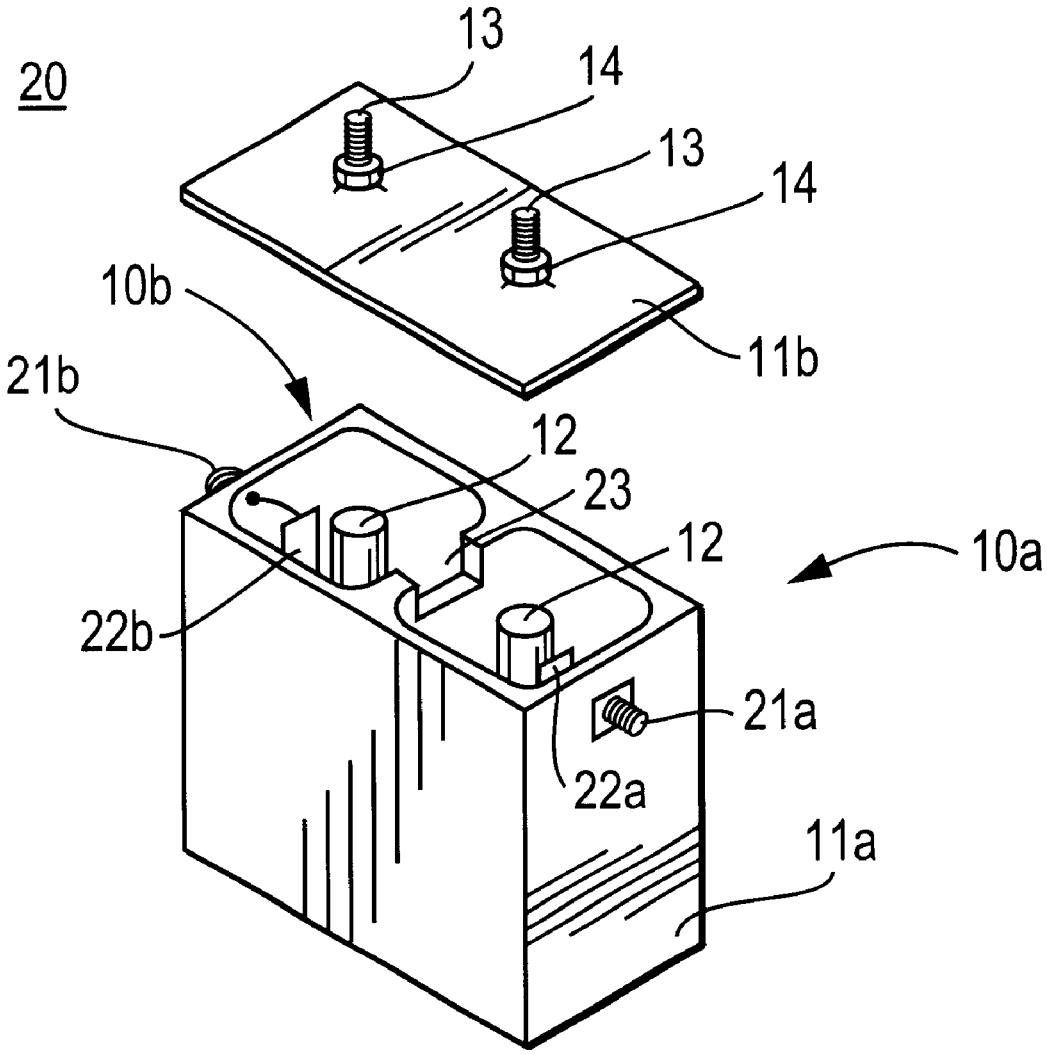
FIG. 3 is an exploded perspective view of a filter according to the present invention.

Next, a filter according to an embodiment of the present invention is described with reference to FIG. 3. FIG. 3 is an exploded perspective view of the filter according to the present embodiment. Components that are identical to their counterparts in the previous embodiment have the same reference numerals and the descriptions of the components are omitted.

As shown in FIG. 3, a filter 20 according to the present embodiment includes a first resonator 10*a* and a second resonator 10*b* and serves as a two-stage band-pass filter. The first resonator 10*a* and the second resonator 10*b* are each identical to the resonator 10 shown in the previous embodiment. An input coaxial connector 21*a* is attached to the casing main unit 11*a* of first resonator 10*a,* and an output coaxial connector 21*b* is attached to the second resonator 10*b*. Loops 22*a* and 22*b* including metal plates, in which ends thereof are grounded for example to the inner bottom of the casing main unit 11*a* and the other ends thereof are electrically connected to the central conductors of the coaxial connectors 21*a* and 21*b,* respectively, are provided in the casing main unit 11*a* for the first and second resonators 10*a* and 10*b*. In addition, a wall surface that divides the first resonator 10*a* and the second resonator 10*b* is provided with a coupling window 23 at the upper edge part thereof, for example.

Such a construction establishes the connection between the first resonator 10*a* and the input loop 22*a,* the connection between the first resonator 10*a* and the second resonator 10*b* via the coupling window 23, and the connection between the second resonator 10*b* and the output loop 22*b*. This allows only a signal of a predetermined frequency among the input signals to be output.

Figure 4:
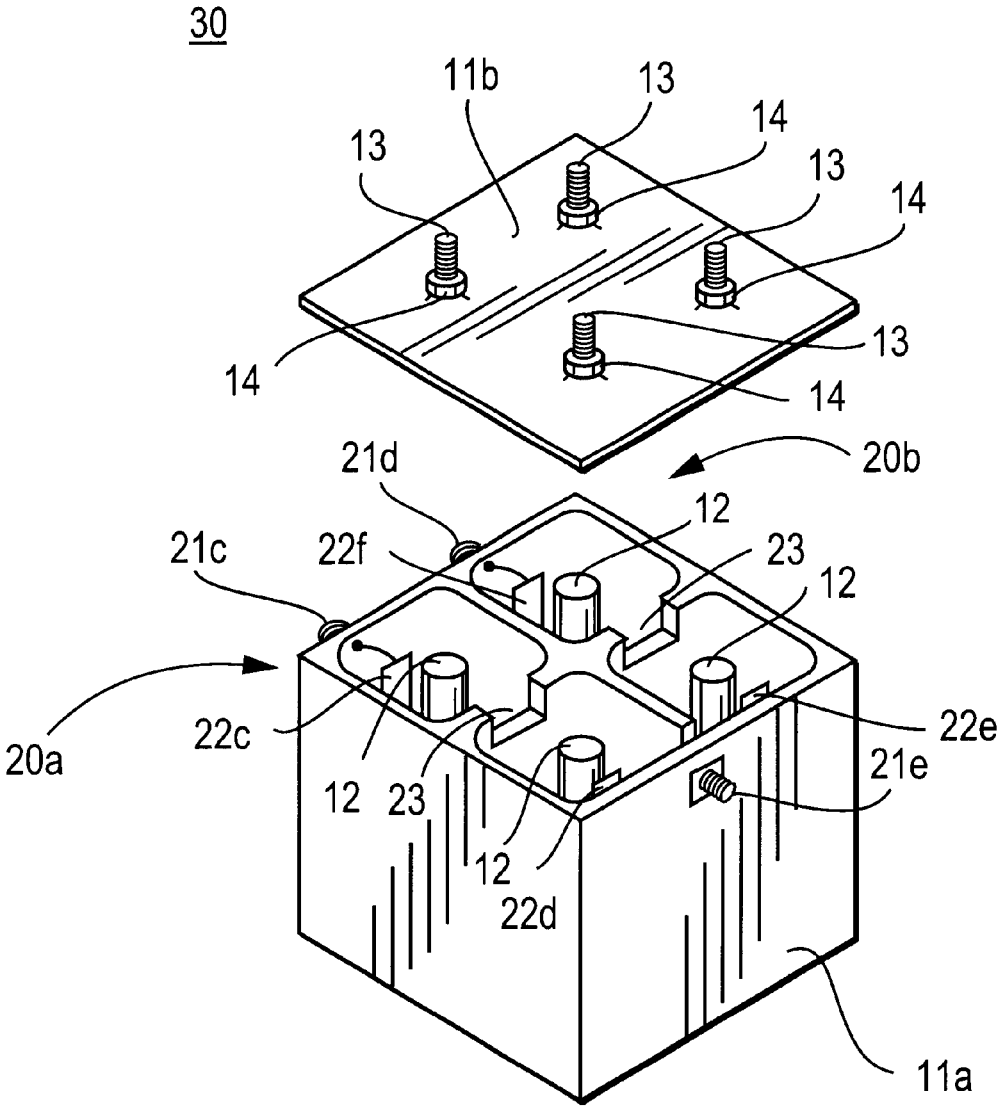
FIG. 4 is an exploded perspective view of a duplexer according to the present invention.

Furthermore, a duplexer according to an embodiment of the present invention is described with reference to FIG. 4. FIG. 4 is an exploded perspective view of the duplexer according to the present embodiment. Components that are identical to the counterparts in the previous embodiments have the same reference numerals and the descriptions of the components are omitted.

As shown in FIG. 4, a duplexer 30 according to the present embodiment includes a transmission filter 20*a* and a reception filter 20*b*. Coaxial connectors 21*c* and 21*d* are attached to the input side of the transmission filter 20*a* and the output side of the reception filter 20*b*, respectively. The output side of the transmission filter 20*a* and the input side of the reception filter 20*b* are both connected to an antenna connection coaxial connector 21*e*. In addition, the central conductors of the coaxial connectors 21*c* to 21*e* are connected to loops 22*c* to 22*f*, respectively.

The transmission filter 20*a* and the reception filter 20*b* of this duplexer 30 may be filters such as shown in the previous embodiment. The transmission filter 20*a* allows a signal of a predetermined frequency band to be passed and the reception filter 20*b* allows a signal of a frequency band different from that of the transmission filter 20*a* to be passed.

Furthermore, a communication apparatus according to an embodiment of the present invention is described with reference to FIG. 5.

Figure 5:
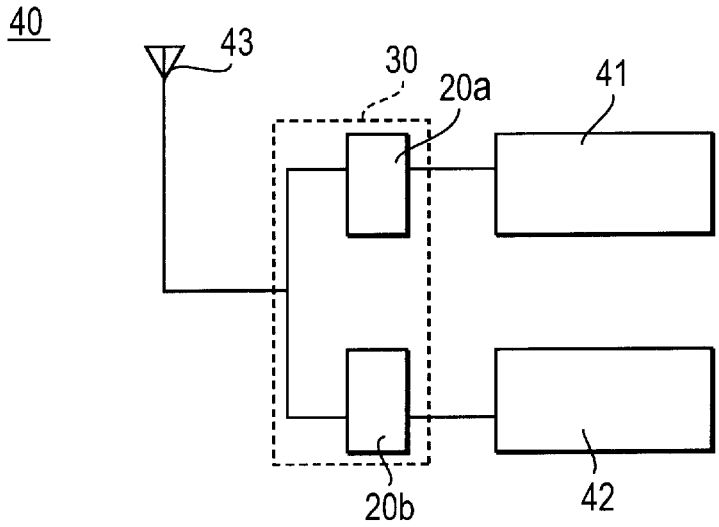
FIG. 5 is a schematic diagram of a communication apparatus according to the present invention.
Figure 6:
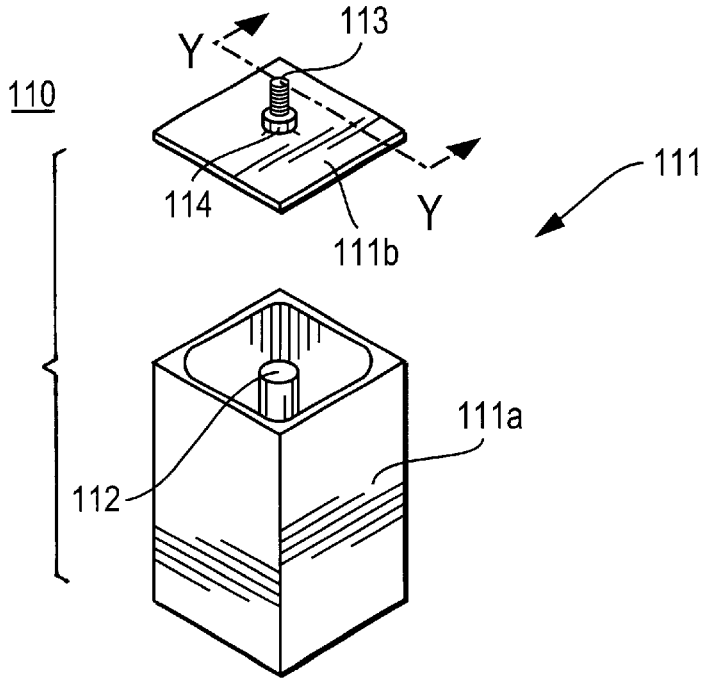
FIG. 6 PRIOR ART
FIG. 6 is an exploded perspective view of a conventional resonator.
Figure 7:
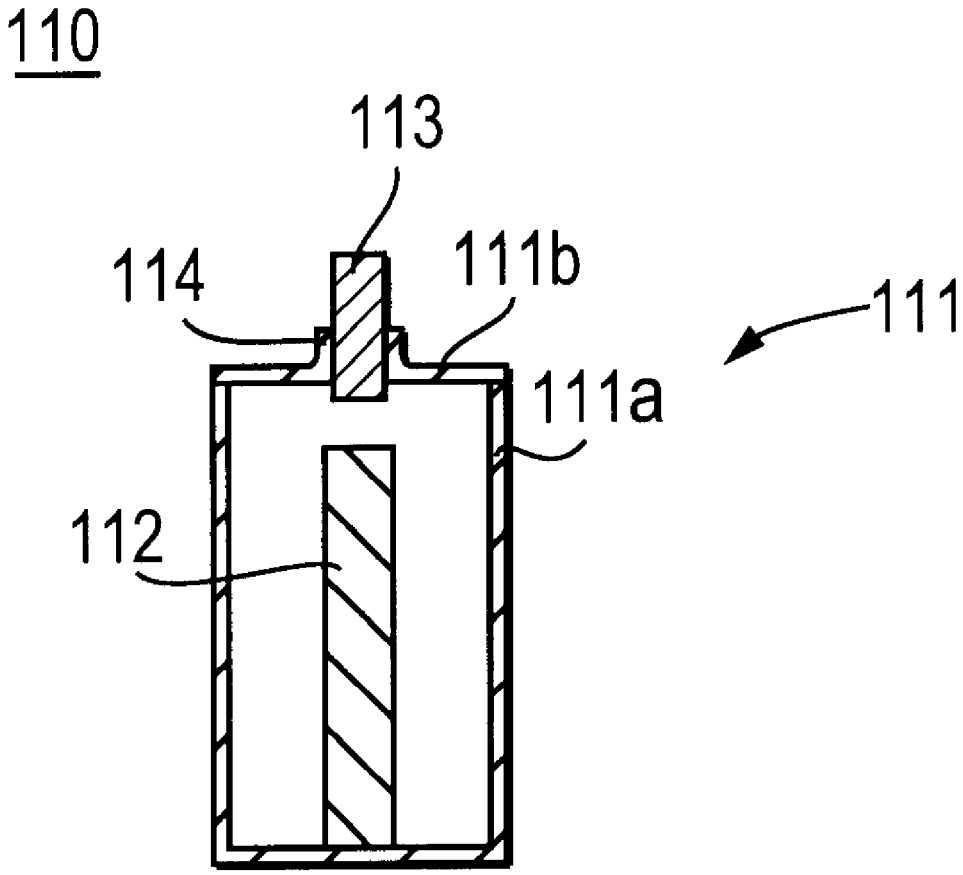
FIG. 7 PRIOR ART
FIG. 7 is a cross-sectional view taken along line Y—Y of FIG. 6.

As shown in FIG. 5, a communication apparatus 40 according to the present embodiment includes the duplexer 30, a transmission circuit 41, a reception circuit 42, and an antenna 43. Here, the duplexer 30 may be the one shown in the previous embodiment. The coaxial connector 21*c* which is connected to the transmission filter 20*a* in FIG. 4 is connected to the transmission circuit 41, and the coaxial connector 21*d* which is connected to the reception filter 20*b* is connected to the reception circuit 42. In addition, the antenna connection coaxial connector 21*e* is connected to the antenna 43.

In addition, either the transmission circuit 41 or the reception circuit 42 may include filters such as shown in the previous embodiments.

In the embodiments described above, resonators that exhibit advantages of the present invention most significantly have been taken as examples. The present invention is not limited to this. For example, the present invention can be applied to a cavity resonator having no inner conductor.

What is claimed is:

1. A duplexer comprising:

at least two filters;

an input/output connection unit connected respectively to each filter; and an antenna connection unit commonly connected to the filters, wherein at least one of the filters comprises a resonator which includes:

a conductive casing provided with a threaded screw hole;

a screw at least partially inserted into said screw hole in said casing; and a fixing member fixing said screw with respect to said casing via a threaded screw hole in said fixing member, wherein said casing and said fixing member are made from the same material; and an input/output connection unit coupled to said resonator.

2. A duplexer according to claim 1, wherein in said resonator, said casing, said fixing member, and said screw are made from the same material.

3. A duplexer comprising:

at least two filters;

an input/output connection unit connected respectively to each filter; and an antenna connection unit commonly connected to the filters, wherein at least one of the filters comprises a resonator which includes:

a conductive casing provided with a threaded screw hole;

a screw at least partially inserted into said screw hole in said casing; and a fixing member fixing said screw with respect to said casing via a threaded screw hole in said fixing member, wherein the linear expansivity of said casing and the linear expansivity of said fixing member are substantially equal; and an input/output connection unit coupled to said resonator.

4. A duplexer according to claim 3, wherein in said resonator, the linear expansivity of said casing, the linear expansivity of said fixing member, and the linear expansivity of said screw are substantially equal.

5. A duplexer according to one of claims 4, 2, 3 and 1, wherein in said resonator, the number of threads of said casing screw hole that engage with said screw and the number of threads of said fixing member screw hole that engage with said screw are substantially equal.

6. A duplexer according to claim 5, wherein, in said resonator:

one end of a rod-shaped inner conductor is connected to the inner wall face of said casing; and a longitudinal axis of the inner conductor and a longitudinal axis of said screw are substantially aligned.

7. A duplexer according to one of claims 4, 2, 3 and 1, wherein, in said resonator:

one end of a rod-shaped inner conductor is connected to the inner wall face of said casing; and a longitudinal axis of the inner conductor and a longitudinal axis of said screw are substantially aligned.

8. A communication apparatus comprising:

a duplexer according to one of claims 4, 2, 3 and 1;

a transmission circuit connected to at least one input/output connection unit of said duplexer;

a reception circuit connected to at least one input/output connection unit that is different from said input/output connection unit connected to said transmission circuit; and an antenna connected to said antenna connection unit of said duplexer.

9. A communication apparatus comprising:

a circuit comprising at least one of a transmission circuit and a reception circuit;

said circuit being connected to a duplexer according to one of claims 4, 2, 3 and 1.

* * * * *